US005431304A

United States Patent [19]

Gentile

[11] Patent Number: 5,431,304

[45] Date of Patent: Jul. 11, 1995

[54] LIQUID AND PARTICULATE PRODUCT DISPENSER

[76] Inventor: Aliseo Gentile, 8011 Schneider, Manchester, Mich. 48158

[21] Appl. No.: 182,851

[22] Filed: Jan. 18, 1994

[51] Int. Cl.[6] ..... B65D 35/28

[52] U.S. Cl. ..... 222/103; 222/107; 222/181.2

[58] Field of Search ..... 222/95, 103, 107, 181, 222/185

[56] References Cited

U.S. PATENT DOCUMENTS 4,565,303 1/1986 Gilbertson ..... 222/185 X 5,105,984 4/1992 Kazimir ..... 222/103

5,322,194 6/1994 Roberts ..... 222/103

*Primary Examiner*—Andres Kashnikow

*Assistant Examiner*—Joseph A. Kaufman

*Attorney, Agent, or Firm*—Harness, Dickey & Pierce

[57] ABSTRACT

A dispenser for single or limited use wedge shaped packages is disclosed having a pair of press surfaces between which the package is positioned. The product is dispensed from the package by opening the package and compressing the package between the two press surfaces causing the product to be discharged from the package.

15 Claims, 2 Drawing Sheets

Fig-1
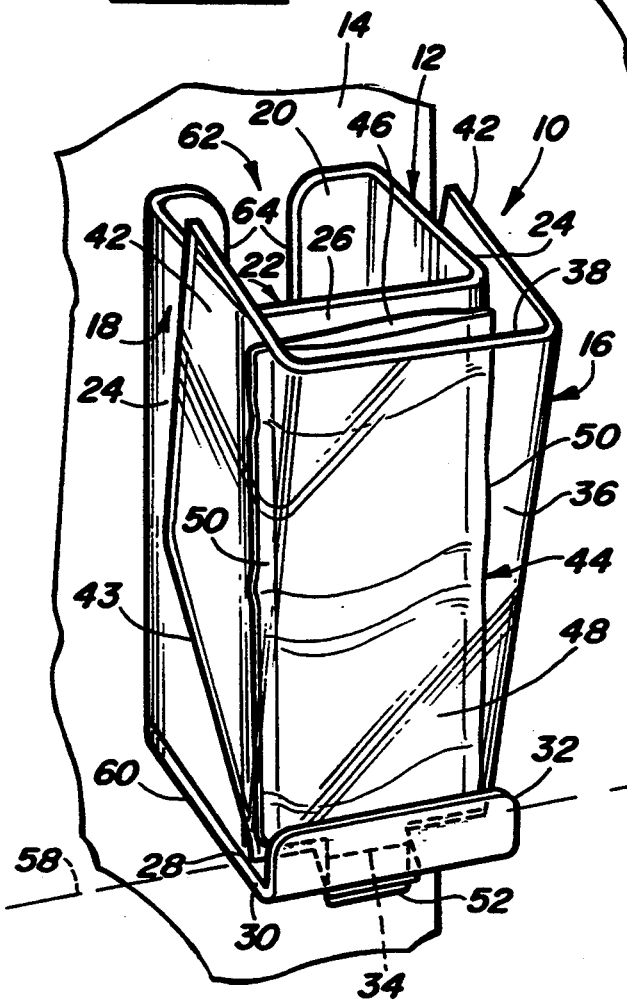
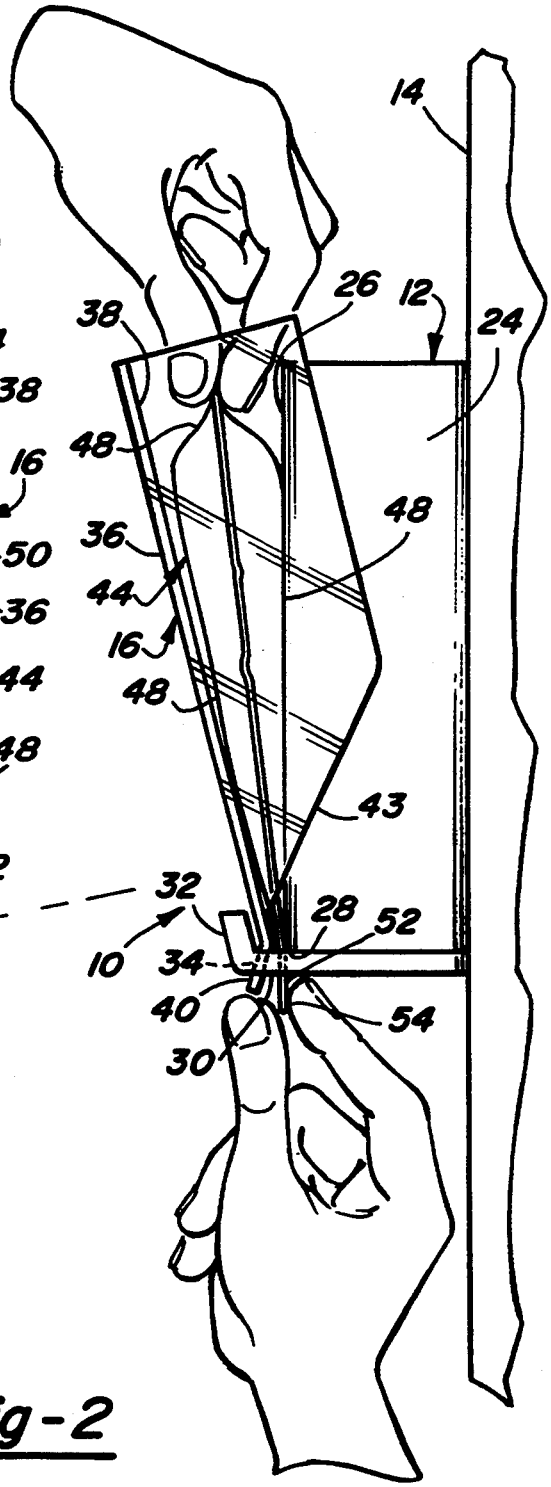
Fig-2

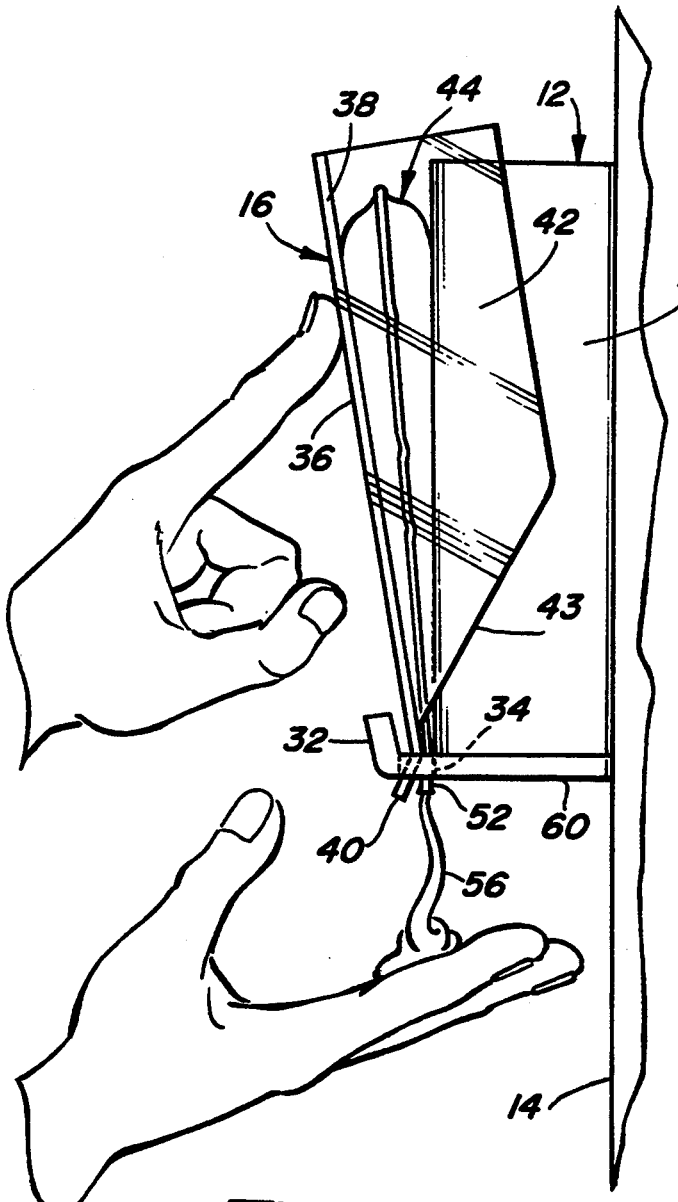
Fig-3
Fig-4
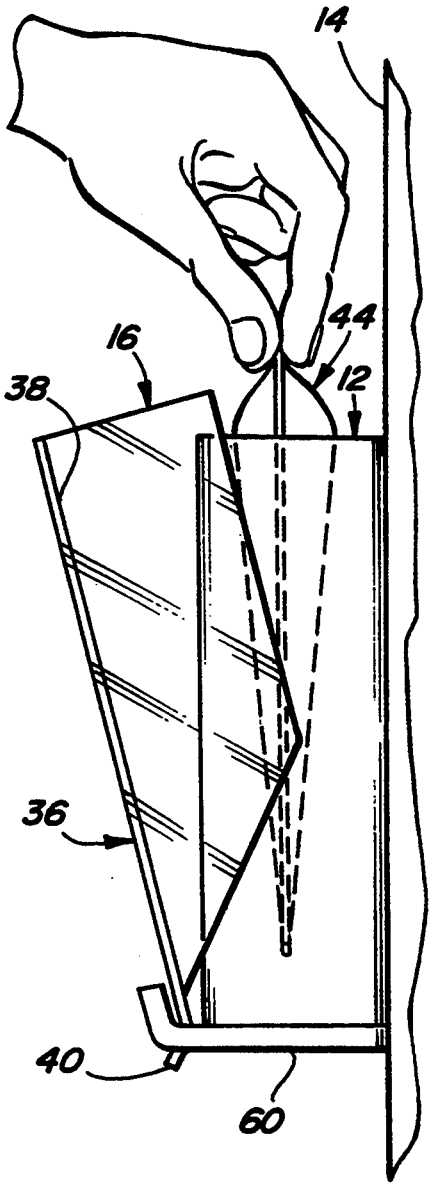

LIQUID AND PARTICULATE PRODUCT DISPENSER

BACKGROUND AND SUMMARY OF THE INVENTION

The present invention relates to a dispenser for liquid and particulate products and in particular to a dispenser for products contained in a generally wedge shaped package having a discharge neck extending from the narrow end of the package.

An increasing number of products are being made available in single or limited use size disposable packages. These packages are frequently used for product samples or to provide a limited amount of a product such as soap, shampoo, conditioner, shaving cream, toothpaste, sunscreen, etc., for a hotel room, athletic club, etc. One type of disposable package is made of a single piece sheet stock material and formed into a generally wedge shaped package having a bottom wall and a pair of sides sealed to one another along the edges of the sides. A narrower tab extending from the sides at the package end opposite from the bottom wall forms a discharge neck. The distal end of the neck is torn off to open the package, allowing the product to be dispensed through the neck at the narrow end of the wedge shaped package. Such packages are relatively simple to mass produce with a minimal amount of scrap sheet stock being produced. Numerous liquid or solid particulate products can be supplied in these packages.

Once the package is open, the contents are dispensed by applying pressure to the sides of the package. In locations where such packages are often used, such as a hotel room or athletic club, a device for holding the package and facilitating dispensing of its contents is needed. The present invention relates to a wall mounted dispenser for such a package.

The wall mounted dispenser includes a holder and a cover. The holder is mounted to the wall and has a press portion forming a first press surface. The cover has a press portion forming a second press surface. The package is placed between the two press surfaces for the application of pressure to the package. The holder includes a lower mounting flange or lip which extends from the holder at its lower end and has a slot therethrough for the neck of the package. Once the package is mounted in the holder with the neck extending down through the mounting flange, the distal end of the package neck is torn off, opening the package. Pressure is applied to the package by moving the cover toward the holder, squeezing the package therebetween. The contents are discharged downward, through the neck at the lower end of the package.

Further objects, features and advantages of the invention will become apparent from a consideration of the following description and the appended claims when taken in connection with the accompanying drawings.

BRIEF DESCRIPTION OF THE DRAWINGS

FIG. 1 is a perspective view of the dispenser of the present invention shown mounted to a wall;

FIG. 2 is a side view of the dispenser in FIG. 1 showing a package being positioned therein;

FIG. 3 is a side view similar to FIG. 2 showing the product being dispensed from the package; and FIG. 4 is a side view similar to FIGS. 2 and 3 showing an empty package being placed in a storage compartment in the dispenser after use.

DETAILED DESCRIPTION OF THE PREFERRED EMBODIMENT

The dispenser of the present invention is shown in FIG. 1 and designated generally at 10. Dispenser 10 includes a holder 12 mounted to a wall 14 and a cover 16.

The holder 12 has a hollow rectangular body 18 with a rear wall 20, a front wall 22 and spaced side walls 24. Front wall 22 functions as a press member having a generally planar press surface 26. At the lower end 28 of the front wall 22, a mounting flange or lip 30 extends horizontally forward from the front wall 22 and terminates in an upwardly bent distal end portion 32. The mounting flange 30 has a vertical slot 34 formed therein approximately at the lateral center of the flange 30.

The cover 16 is generally U-shaped in horizontal cross section as can be seen from FIG. 1 and includes a front wall or press wall which functions as a press member 36 having a generally planar press surface 38. At its lower end, the cover front wall 36 has a downwardly extending tab 40 which is positioned laterally in the center of the wall 36. The tab is inclined forward relative to the press surface 38 as shown in FIGS. 2, 3 and 4. The cover is mounted on the holder by insertion of the tab 40 through the slot 34 in the mounting flange 30. By inserting the tab 40 into the flange 30 in a vertical orientation, the cover front wall 36 will be inclined upwardly and away from the holder front wall 22. The two press surfaces are thus in a confronting juxtaposition and inclined relative to one another. This forms a wedge shape cavity between the press surfaces 26 and 38 and having an open upper end. The cover is preferably made of a transparent material to enable the user to see the package.

The cover 16 includes a pair of cover side walls 42 which are generally parallel to one another and overlay the holder side walls 24. The cover and holder are sized so that the cover and holder side walls frictionally engage one another and retain the cover in a given position on the holder. The lower edges 43 of the cover side walls are inclined upwardly and away from the lower end of the cover front wall 36. The cover side walls are thus trapezoidal in shape. This reduces the surface area of contact between the cover and holder side walls at the time when the cover is being placed on the holder with the cover front wall inclined relative to the holder front wall.

A wedge shaped package 44 is placed in the dispenser 10 for dispensing the contents from the package 44. Package 44 is a wedge shaped package made of a single piece of a flexible sheet stock such as laminated cardboard or the like. The single piece sheet stock is folded in half and shaped to form a bottom 46 and sides 48. The sides are joined to one another along their edges 50 to seal the package closed. At the narrow end of the wedge shaped package, opposite from the bottom 46, a tab extends from the two sides 48 forming a neck 52.

The package 44 is inserted into the dispenser cavity between the cover and holder with the neck 52 projecting downward through the slot 34 in the mounting flange 30. Once the package is positioned as shown in FIG. 2, a distal end portion 54 of the neck 52 is torn off, opening the package.

The product 56 is dispensed from the package 44 by moving the cover 16 relative to the holder 12, as shown in FIG. 3, to compress the package 44 between the cover and holder. The cover 16 is rotated generally about a transverse axis 58 at the lower end of the two press surfaces. As the cover 16 is rotated, the cover side walls 42 slide over the holder side walls 24.

The hollow rectangular body 18 of the holder is closed by a bottom wall 60. The top of the body 18 is open from above as shown in FIG. 1. Unused packages can be stored in the interior of the holder as shown in FIG. 4.

By locating the dispensers 10 in hotel rooms, locker rooms, restrooms, etc., a convenient means for using a single or limited use wedge shaped product package is provided. The holder and cover can be made of a variety of materials. Plastic sheet stock is a convenient material. The holder 12 is shown made of two plastic pieces molded to the desired shape. The rear, front and side walls are of one piece of sheet stock bent to form the hollow body 18. The bottom wall 60 and mounting flange 30 are made of a second piece which is bent upwardly to form the upwardly bent distal end portion 32. The slot 62 formed between the ends 64 of the sheet forming the holder can be used to mount the holder on a wall fixture (not shown). The cover 16 is made of a one piece plastic sheet stock which is bent to form the side walls and tab 40.

It is to be understood that the invention is not limited to the exact construction illustrated and described above, but that various changes and modifications may be made without departing from the spirit and scope of the invention as defined in the following claims.

I claim:

1. A dispenser for products contained in a flexible package, said package having a bottom wall and a pair of side walls forming a generally wedge shaped body and having a neck extending from said body opposite said bottom wall with a passage therethrough for discharge of said product from said package, said dispenser comprising:

a first press member having a generally planar first press surface and a lower end;

a second press member movably mounted to said first press member at said lower end and having a second press surface in confronting juxtaposition to and inclined relative to said first press surface forming a wedge shaped cavity therebetween with an open upper end;

means for positioning one of said packages in said cavity through said open upper end and between said first and second press surfaces with said neck projecting downwardly below said lower end of said first press surface; and said second press member being movable relative to said first press member to compress said package between said first and second press surfaces causing said product to be discharged from said package through said neck.

2. The dispenser of claim 1 wherein said second press member is movably mounted for rotation relative to said first press member.

3. The dispenser of claim 2 wherein said second press member rotates relative to said first press member about an axis located near said lower end of said first press surface.

4. The dispenser of claim 1 wherein said second press member is mounted to said first press member for removal of said second press member by hand manipulation of said second press member.

5. The dispenser of claim 1 further comprising storage means for storing said packages.

6. A dispenser for products contained in a flexible package, said package having a bottom wall and a pair of side walls forming a generally wedge shaped body and having a neck extending from said body opposite said bottom wall with a passage therethrough for discharge of said product from said package, said dispenser comprising:

a holder having a first press portion forming a generally planar first press surface having a lower end, a horizontal mounting flange extending from said first press surface at said lower end, said mounting flange having a vertical slot therethrough; and a cover having a second press portion forming a generally planar second press surface also having a lower end, a tab extending from said lower end of said second press surface at an angle relative to said second press surface for insertion into said slot of said mounting flange to mount said cover onto said holder with said first and second press surfaces being in confronting juxtaposition and inclined relative to one another to form a wedge shaped cavity between said press surfaces for positioning one of said packages between said press surfaces with said neck projecting downwardly through said slot below said mounting flange, said cover being movable relative to said holder when said cover is mounted to said holder to compress said package between said first and second press surfaces to discharge said product from said package body through said neck.

7. The dispenser of claim 6 wherein said cover is movably mounted to said holder for rotation relative to said holder about an axis adjacent said lower ends of said first and second press surfaces.

8. The dispenser of claim 6 wherein said cover is mounted to said holder for removal of said cover by hand manipulation of said cover.

9. The dispenser of claim 6 further comprising storage means for storing said packages.

10. The dispenser of claim 6 wherein said holder is a hollow body with spaced front and rear walls and spaced side walls, said front wall forming said first press portion and an exterior surface of said front wall forming said first press surface, said hollow body having a bottom wall and being open from above whereby said hollow body can be used to store said packages after use.

11. The dispenser of claim 10 wherein said spaced side walls are parallel to one another and normal to said front wall.

12. The dispenser of claim 11 wherein said cover has a press wall, a surface of which forms said second press surface and a pair of spaced generally parallel side walls normal to said press wall and extending from said press wall along opposite edges thereof whereby said cover has a generally U-shaped cross section, said cover press wall and side walls being of a size to fit over said front wall and side walls of said holder and to frictionally engage said holder side walls to retain said cover in position on said holder.

13. The dispenser of claim 11 wherein said hollow body is made of two pieces of sheet plastic, a first piece bent to form said rear, front and side walls and a second piece forming said bottom wall and said horizontal mounting flange.

14. The dispenser of claim 12 wherein said cover is made of a single piece of sheet plastic bent to form said cover front wall and said cover side walls.

15. The dispenser of claim 12 wherein said cover side walls have a lower edge which is inclined upwardly and away from the lower end of said second press surface.

* * * * *